US007967662B2

(12) United States Patent
Kobayashi et al.

(10) Patent No.: US 7,967,662 B2
(45) Date of Patent: Jun. 28, 2011

(54) APPARATUS FOR LAPPING SLIDERS USING AXIALLY DEFORMABLE MEMBER

(75) Inventors: Masashi Kobayashi, Hong Kong (CN); Kiyohiko Abe, Hong Kong (CN); Hiroyasu Tsuchiya, Hong Kong (CN); Santoso Tan, Hong Kong (CN); Zhong Xian Wei, Hong Kong (CN); Chun Hua Zhang, Hong Kong (CN); Fa Hong Li, Hong Kong (CN); Ming Yuan Chen, Hong Kong (CN)

(73) Assignee: SAE Magnetics (H.K.) Ltd., Hong Kong (CN)

( * ) Notice: Subject to any disclaimer, the term of this patent is extended or adjusted under 35 U.S.C. 154(b) by 507 days.

(21) Appl. No.: 12/149,174

(22) Filed: Apr. 28, 2008

(65) Prior Publication Data

US 2008/0280544 A1 Nov. 13, 2008

(30) Foreign Application Priority Data

May 8, 2007 (JP) ..... 2007-122965

(51) Int. Cl.
*B24B 49/00* (2006.01)

(52) U.S. Cl. ..... 451/11; 451/264; 451/265; 29/603.12

(58) Field of Classification Search ..... 451/11, 451/264, 265, 314; 29/603.12
See application file for complete search history.

(56) References Cited

U.S. PATENT DOCUMENTS

| | | | | |
|---|---|---|---|---|
| 5,468,177 | A * | 11/1995 | Kindler et al. | 451/364 |
| 5,516,323 | A * | 5/1996 | Carlson et al. | 451/28 |
| 5,591,073 | A * | 1/1997 | Turgeon | 451/314 |
| 6,080,043 | A * | 6/2000 | LeVan | 451/41 |
| 7,260,887 | B2 * | 8/2007 | Beaucage et al. | 451/41 |

FOREIGN PATENT DOCUMENTS

| | | |
|---|---|---|
| JP | 10-249714 | 9/1998 |
| JP | 2002-157723 | 5/2002 |

* cited by examiner

*Primary Examiner* — Maurina Rachuba
(74) *Attorney, Agent, or Firm* — Nixon & Vanderhye PC

(57) ABSTRACT

An apparatus for lapping sliders comprises a rotatable lapping plate for lapping elements that are to be formed into sliders, a pushing force adjusting member that has an internal space therein and that extends vertically along an lapping plate axis that is perpendicular to the lapping plate, a pusher for pressing the elements, the pusher being connected to the pushing force adjusting member, and gas supply means for supplying a gas into the internal space, the gas supply means being connected to the pushing force adjusting member. The pushing force adjusting member comprises a first part that includes a connection with the pusher, a second part that includes a coupling between the internal space and the gas supply means, and an axially deformable part that is located between the first part and the second part. A length of the axially deformable part changes in a direction of the lapping plate axis in accordance with pressure in the internal space such that deformation of the axially deformable part causes a change in the pushing force of the pushing force adjusting member against the pusher.

5 Claims, 9 Drawing Sheets

PRIOR ART

APPARATUS FOR LAPPING SLIDERS USING AXIALLY DEFORMABLE MEMBER

The present application is based on, and claims priority from, J.P. Application No. 2007-122965, filed on May 8, 2007, the disclosure of which is hereby incorporated by reference herein in its entirety.

BACKGROUND OF THE INVENTION

1. Field of the Invention

The present invention relates to an apparatus for lapping sliders, and particularly to a mechanism for pushing a bar against a lapping plate.

2. Description of the Related Art

Sliders used in hard disk drives are fabricated through a wafer process in which read elements and write elements are formed, a process for dicing the wafer into blocks or bars, a lapping process for forming a predetermined air bearing surface, and so on. The lapping process usually consists of two or three separate lapping processes.

First, a rough lapping process, which may be omitted, is performed in order to improve efficiency in the subsequent element height forming lapping process. In this rough lapping process, a block or a bar having a number of elements that are to be formed into sliders (hereinafter, simply referred to as "elements") formed thereon is lapped until the read element height reaches a target value thereof. The term "read element height" as used herein means a length (depth) of a read element that is measured in a direction that is perpendicular to the air bearing surface of an MR (Magneto Resistive) element, and the read element height plays an important role in achieving preferable properties, such as an MR ratio.

Next, in order to accurately form the read element height, a second lapping process called an element height forming lapping process is performed. This lapping process is also called a height adjustment lapping process. Accurate formation of the read element height is significantly important, and a lapping method using resistance elements, such as RLG (Resistance Lapping Guide), is known. The resistance elements are formed in advance between the MR elements in a wafer process, and each resistance element is electrically connected, at both ends thereof, to pads, which are formed on a surface of a bar that is other than the lapping surface of the bar, via inside of the elements. During lapping, electric resistance of the resistance elements is measured via the pads. The resistance elements are lapped together with the MR elements, and thereby the electric resistance of the resistance elements is increased as lapping progresses. Thus, by obtaining, in advance, the relationship between the amount in which the elements are lapped and the electric resistance and by lapping the elements while monitoring the electric resistance of the resistance elements, it is possible to indirectly estimate the lapping amount of the elements during lapping.

However, when a plurality of elements, which are formed in a bar, are simultaneously lapped using the above described method, it is not possible to completely prevent variation in the lapping amount among the elements during lapping. Recently, a technology has been disclosed to reduce the variation in the lapping amount during lapping by using a plurality of pressing cylinders for individual elements and thereby applying optimum pressing force to each element (see Japanese Patent Laid-Open Publication No. 2002-157723).

The final lapping process is a so-called surface finishing lapping process, which is often called a touch lap process. In the surface finishing lapping process, a mirror finished lapping plate is used to lap the air bearing surface. The surface finishing lapping process removes scratches and the like on the air bearing surface so that smoothness of the air bearing surface can be improved. In this process, a convex shape called a crown is simultaneously formed on the air bearing surface, which is important for flying properties of a slider. In the surface finishing lapping process, the lapping amount itself is not monitored because the lapping amount is small and the pressing force is limited. Lapping is completed when a certain period of time of lapping lapses based on a lapping rate which has been estimated in advance. As means for applying pressing force, Japanese Patent Laid-Open Publication No. 2002-157723 discloses a method for applying optimum pressing force to each element by using a plurality of pressing cylinders, as carried out in the element height forming lapping process. Also, a simpler method is disclosed in Japanese Patent Laid-Open Publication No. 249714/98, in which a weight is put on a lapping head that holds elements.

When a pressing cylinder is employed, an air actuation type is typically used. FIG. 1 is a conceptual sectional view illustrating a cylinder section that generates pressing force. Piston 72 is slidably mounted in cylinder 71, and pusher 6 is connected to the end of piston 72. Accordingly, the pushing force of pusher 6 can be controlled by controlling movement of piston 72. Air tube 10 for supplying air into cylinder 71 is connected to one end of the cylinder. A plurality of pushers 6 are provided in the longitudinal direction of a bar, and the pushing force of each pusher 6 can be individually controlled by adjusting the amount of air that is supplied into cylinder 71 and thereby controlling pressure in cylinder 71. Piston 72 may be integrated with pusher 6.

It is desirable that the bar be pressed with force that is as uniform as possible while being lapped. If the bar is subjected to large pushing force locally, only the portion that is subjected to the large pushing force is lapped in a large amount, leading to a variation in the lapping amount. If the pressing force varies, then elements subjected to a large pressing force may be damaged in the worst case. Moreover, since the elements are actually lapped in a certain amount in the surface finishing lapping process, variation in the element heights that is minimized in the previous element height forming lapping process may be increased again. According to the investigation conducted by the inventors of the present invention, the variation in the element height (MR height) after the surface finishing lapping process is performed is larger than the variation after the element height forming lapping process is performed by about 3 nm. An increase in the recording density of a magnetic head in the future requires a reduction in the element height, and therefore, an increase in the variation in the element height in the surface finishing lapping process makes it difficult to achieve higher recording density of a magnetic head. Variation in the pressing force may also increase variation in the dimension of recesses formed near the read and write element, i.e., PTR (Pole Tip Recession). For example, if a read element is retracted in a direction away from the air bearing surface relative to the substrate that is made of $Al_2O_3$/TiC, then the read element is away from a recording medium, and the desired reading property can not be achieved. Therefore, an increase in the variation in the PTR also leads to a degradation of yield.

Furthermore, if the pressing force varies, then the lapping plate itself, in turn, is subjected to large reaction force from the elements, at locations of the lapping plate (the concave portions) where a large pressing force is applied to the elements. The reaction force may cause fine scratches on the lapping plate, which may reduce the lifetime of the lapping plate because the surface finishing lapping process requires a lapping plate that is mirror finished with high precision.

However, it is actually difficult to maintain a uniform pushing force. FIG. 2 is a schematic view illustrating the relationship between force that is applied to a piston via air pressure (a product of differential pressure between the upper surface and the lower surface of a piston and a cross section thereof and a displacement of the piston. The pushing force of the pusher is in proportion to the displacement of the piston. The problem to be solved by the present invention will now be described more in detail with reference to FIG. 2. In the figure, force P, which is applied to the piston via air pressure, and displacement D of the piston are defined to be positive when they are directed downward in the figure (See FIG. 1).

As the pressure inside the cylinder is gradually increased, force P is increased gradually, and accordingly displacement D of the piston is also increased. The broken line shows an ideal case in which a linear relationship exists between force P and displacement D. In other words, when force P that corresponds to a desired pushing force, which is determined in advance, is given, a desired displacement X, and accordingly, a desired pushing force is always ensured. However, the relationship between force P and displacement D is actually non-linear because of friction between the piston and the cylinder. Specifically, when force P is gradually increased, the piston remains stationary for a while because of the friction, and when force P is further increased, the piston is moved (point A) and is stopped at point B. Thereafter, when the pusher is temporarily pushed upwards by the lapping plate or moves away from the lapping plate, for example, due to unevenness of the lapping plate, only displacement D temporarily fluctuates about point B while force P is kept constant. The fluctuating displacement that is caused by the upward pushing motion etc. is not in a linear relationship with the reaction force because of the friction between the piston and the cylinder. For this reason, when the upward pushing motion is ended and the initial state is recovered, displacement D of the piston does not always return to point B, but shifts, for example, to point C which is away from point B. If there is no friction between the piston and the cylinder, however, displacement D returns to displacement X after the upward pushing motion etc. is ended even if such motions temporarily occur.

As described above, the pushing force of a pusher is controlled by air pressure in the cylinder. However, a constant displacement, and accordingly, constant pushing force can not obtained even if constant air pressure is applied because of the non-linear relationship between force P and displacement D. In addition, even if constant air pressure is applied, displacement D fluctuates, and as a result, the pushing force also fluctuates. Therefore, it is difficult to obtain constant pushing force of the pusher, no matter how accurately the air pressure in the cylinder is controlled.

SUMMARY OF THE INVENTION

An object of the present invention is to provide an apparatus for lapping sliders that enables a reduction in the variation of pressing force with which sliders that are to be lapped are pushed against a lapping plate.

According to an embodiment of the present invention, an apparatus for lapping sliders comprises a rotatable lapping plate for lapping elements that are to be formed into sliders, a pushing force adjusting member that has an internal space therein and that extends vertically along an lapping plate axis that is perpendicular to the lapping plate, a pusher for pressing the elements, the pusher being connected to the pushing force adjusting member, and gas supply means for supplying a gas into the internal space, the gas supply means being connected to the pushing force adjusting member. The pushing force adjusting member comprises a first part that includes a connection with the pusher, a second part that includes a coupling between the internal space and the gas supply means, and an axially deformable part that is located between the first part and the second part. A length of the axially deformable part changes in a direction of the lapping plate axis in accordance with pressure in the internal space such that deformation of the axially deformable part causes a change in the pushing force of the pushing force adjusting member against the pusher.

According to an apparatus for lapping sliders thus configured, the gas that is supplied by the gas supply means flows into the internal space of the pushing force adjusting member. The axially deformable part of the pushing force adjusting member deforms in the direction of the lapping plate axis due to the pressure of the gas that flows into the internal space. In other words, the axially deformable part acts as a member that is equivalent to a spring which deforms in the direction of the lapping plate axis. Therefore, when a gas is supplied into the pushing force adjusting member from the gas supply means with a predetermined pressure, the pushing force adjusting member is displaced in the direction of the lapping plate axis in an amount that corresponds to the pressure, and presses the pusher with a constant pushing force. In the apparatus for lapping sliders according to the present invention, no frictional force is generated between the piston and the cylinder, unlike conventional art, and the pushing force of the pusher is only controlled by the elastic deformation of the pushing force adjusting member. Accordingly, the relationship between the pressure in the internal space and the pushing force of the pusher tends to be linear, and enables the apparatus to easily generate a desired pushing force and to keep a constant pushing force.

As discussed above, the present invention can provide an apparatus for lapping sliders that enables a reduction in the variation of pressing force with which sliders that are to be lapped are pushed against a lapping plate.

The above and other objects, features and advantages of the present invention will become apparent from the following description with reference to the accompanying drawings which illustrate examples of the present invention.

DETAILED DESCRIPTION OF THE INVENTION

Next, an apparatus and a method for lapping sliders according to an embodiment of the present invention will be explained in detail with reference to the drawings.

Figure 1:
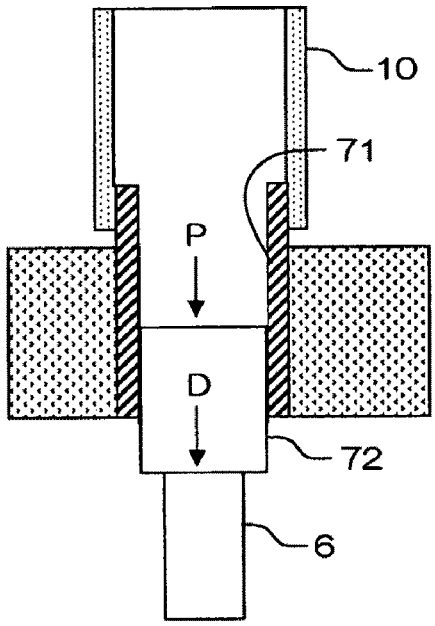
FIG. 1 is a conceptual sectional view illustrating a conventional cylinder section.
Figure 2:
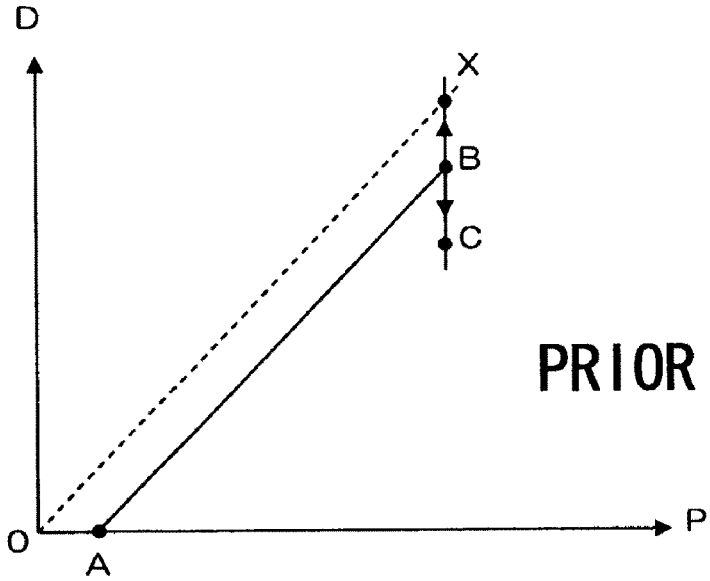
PRIOR ART Fig.2
FIG. 2 is a schematic view showing the relationship between the force applied to a piston via air pressure and a displacement of the piston.
Figure 3:
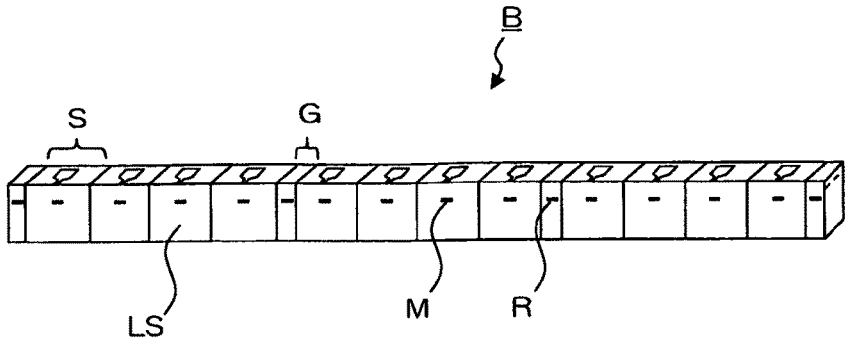
FIG. 3 is a perspective view showing a bar having a number of elements that are to be formed into sliders formed thereon.

First, explanation will be made about elements that are to be lapped in accordance with the present embodiment. FIG. 3 is a perspective view showing a bar having a number of elements that are to be formed into sliders formed thereon. Bar B is fabricated by dicing a wafer to separate a part of elements S formed thereon. Each element S includes MR element M, which is a read element. MR elements M are positioned on the air bearing surface and are lapped into a predetermined element height. Therefore, the air bearing surface on which MR elements M are formed corresponds to lapping surface LS of bar B. Elements S are arranged in a line and gap G is formed between adjacent elements S. Gap G is provided with RLG element R that faces lapping surface LS. RLG element may have the same film structure as MR element M, and may be fabricated simultaneously with MR elements in the wafer process. RLG element is electrically connected to pads (not shown) at both ends thereof. The pads are provided on a surface of bar B other than lapping surface LS. In FIG. 3, gap G is formed between a set of elements S in which elements S are arranged in series and another set of elements S in which elements S are arranged in series, but may be formed between every pair of adjacent elements S. A dicing margin (not shown) provided between every pair of adjacent elements S may be used as gap G. Although bar B is the object of lapping in this embodiment, it should be noted that a wafer may be separated into several blocks first, and then each block may be separated into bars B. In this case, the block may be the object of lapping.

Figure 4:
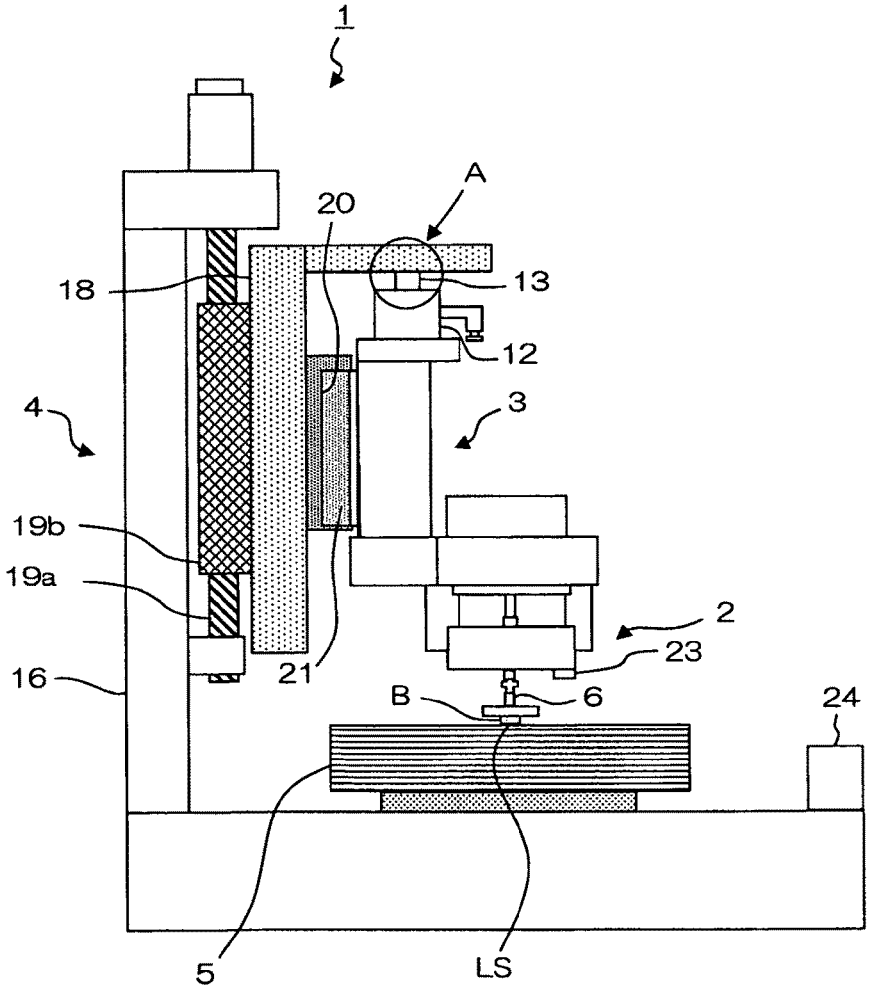
FIG. 4 is a conceptual view showing an apparatus for lapping sliders according to an embodiment of the present invention.

FIG. 4 is a conceptual view showing an apparatus for lapping sliders according to an embodiment of the present invention. This lapping apparatus can be used in the surface finishing lapping process that constitutes the slider lapping process described above, but may be used in the element height forming lapping process or in the other lapping process.

Slider lapping apparatus 1 includes lapping head 2, holding mechanism 3 for supporting lapping head 2, and base 4 for supporting holding mechanism 3. Base 4 has rotatable lapping plate 5 mounted thereon. Lapping head 2 is adapted to hold bar B such that lapping surface LS faces lapping plate 5. Bar B is pressed against the rotating lapping plate 5 in order to be lapped. In FIG. 4, the longitudinal direction of bar B extends perpendicularly to the drawing.

Figure 5:
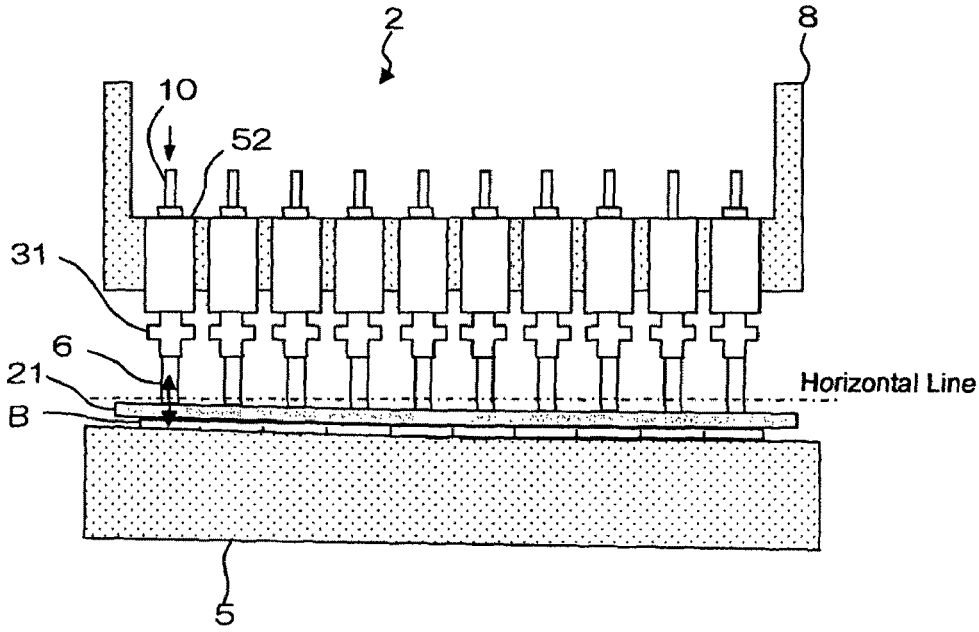
FIG. 5 is a conceptual view illustrating the structure of a lapping head.

FIG. 5 is a conceptual view showing the structure of the lapping head. In FIG. 5, the longitudinal direction of bar B extends from right to left in the drawing. Lapping head 2 has a plurality of cylindrical pushers 6 to press bars B against lapping plate 5 via rubber sheet G. Pushers 6 are positioned right above the positions of respective elements S. Pushing force adjusting member 31 that is supported by pusher supporting member 8 is connected to each pusher 6. Pusher 6 presses bar B against lapping plate 5 with a pushing force which pusher 6 is subjected to from pushing force adjusting member 31. In FIG. 5, which emphasizes the deformation of lapping plate 5 in the radial direction, upward deformation of lapping plate 5 is increased toward the left side in the drawing.

Figure 6A:
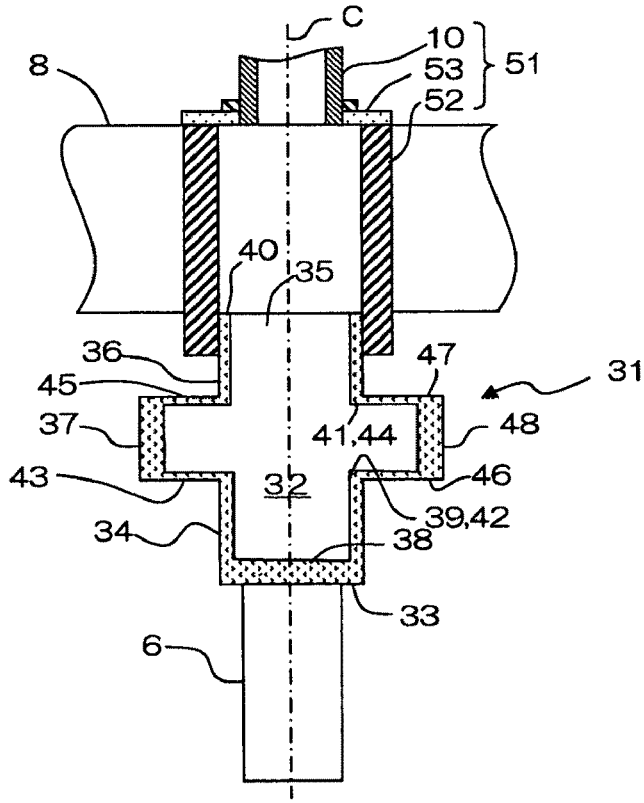
FIGS. 6A and 6B are partial enlarged views of the lapping head shown in FIG. 5.
Figure 6B:
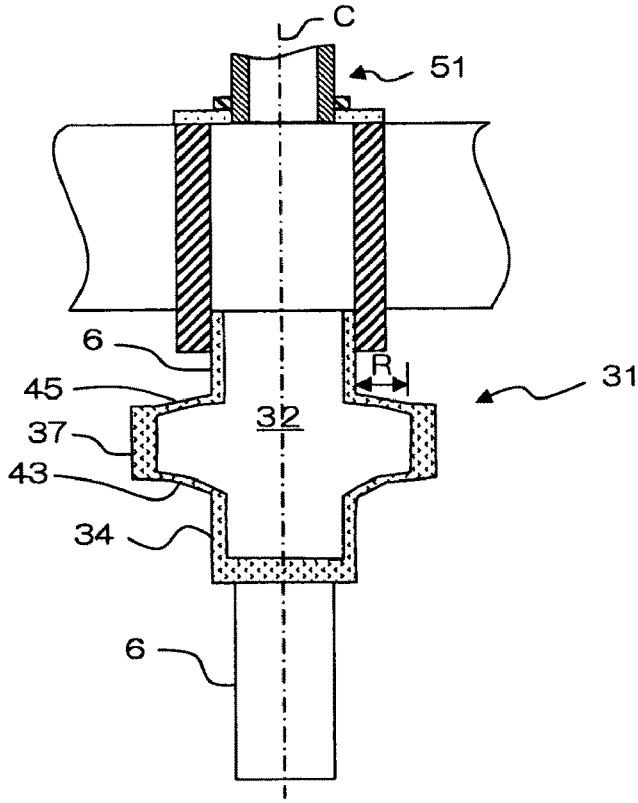

FIG. 6A and FIG. 6B are partial enlarged views of the lapping head shown in FIG. 5. Referring to FIG. 6A, lapping head 2 includes pusher 6 and pushing force adjusting member 31, as well as gas supply means 51.

Pushing force adjusting member 31 is made of an elastic material, such as a rubber, and pusher 6 is attached to end 33 of pushing force adjusting member 31 that is located on the side of bar B. Pushing force adjusting member 31 has internal space 32, and extends along lapping plate axis C that is perpendicular to lapping plate 5. Pushing force adjusting member 31 has first part 34 that includes connection 33 with pusher 6, second part 36 that includes coupling 35 between internal space 32 and gas supply means 51, and axially deformable part 37 which is located between first part 34 and second part 36. First part 34 has a cylindrical shape having closed end 38 that is located on the side of connection 33 with pusher 6 and open end 39 that is located on the side that is opposite to connection 33. Second part 36 has a cylindrical shape having open end 40 that is located on the side of coupling 35, and another open end 41 that is located on the side that is opposite to coupling 35. Axially deformable part 37 has first circular part 43. First circular part 43 has lapping plate axis C, which is perpendicular to lapping plate 5, as the center axis thereof. Inner circumference 42 of first circular part 43 corresponds to the outer circumference of open end 39 of first part 34, wherein open end 39 is located on the side that is opposite to connection 33. Also, axially deformable part 37 has second circular part 45 which has lapping plate axis C as the center axis thereof. Inner circumference 44 of second circular part 45 corresponds to the outer circumference of open end 41 of second part 36, wherein open end 41 is located on the side that is opposite to coupling 35. Outer circumference 46 of first circular part 43 and outer circumference 47 of second circular part 45 are connected by cylindrical part 48. First circular part 43 and second circular part 45 have smaller thicknesses than the other parts of pushing force adjusting member 31.

Gas supply means 51 is connected to pushing force adjusting member 31 in order to supply gas into internal space 32 of pushing force adjusting member 31. Air is used as the gas, but nitrogen gas or other gases can also be used. Gas supply means 51 includes cylinder 52 that is fixed to pusher supporting member 8, end plate 53 that is attached to cylinder 52, air tube 10 that is attached to cylinder 52 via end plate 53, and an air source (not shown) that is connected to air tube 10. Pushing force adjusting member 31 is fixed to cylinder 52 at the location of coupling 35. In the illustrated embodiment, air tube 10 is attached to pushing force adjusting member 31 via cylinder 52 and end plate 53, but air tube 10 may also be directly attached to pushing force adjusting member 31.

When the gas is supplied from gas supply means 51 into internal space 32 of pushing force adjusting member 31, as shown in FIG. 6B, first circular part 43 and second circular part 45 of axially deformable part 37 are bent in the direction of lapping plate axis C. Although axial force in the direction of lapping plate axis C is also generated in the other parts of pushing force adjusting member 31, deformation in the direction of lapping plate axis C is limited. Accordingly, the deformation of pushing force adjusting member 31 in the direction of lapping plate axis C substantially depends on the deformation of axially deformable part 37. The deforming characteristics can be easily adjusted by changing radial width R, the thickness and material etc. of first circular part 43 and second circular part 45. When the air pressure changes, the deformation of pushing force adjusting member 31 in the direction of lapping plate axis C also changes, and thereby the pushing force of pushing force adjusting member 31 against pusher 6 changes. Thus, the pushing force with which pusher 6 presses bar B can be controlled by the air pressure.

As described above, pushing force adjusting member 31 according to the present embodiment changes the length thereof in the direction of lapping plate axis C in accordance with the pressure in internal space 32. The arrangement of the present embodiment and a conventional arrangement that uses a combination of a piston and a cylinder are common in that the pusher is pressed with air pressure. However, the arrangement of the present embodiment uses elastic deformation of pushing force adjusting member 31 in order to press the pusher, and accordingly causes no frictional resistance between the piston and the cylinder. Therefore, the arrangement of the present embodiment realizes the linear relationship between the pressure in internal space 32 and the pushing force of pusher 6, and accordingly, constant pushing force can be easily realized by controlling the pressure in internal space 32.

Figure 7:
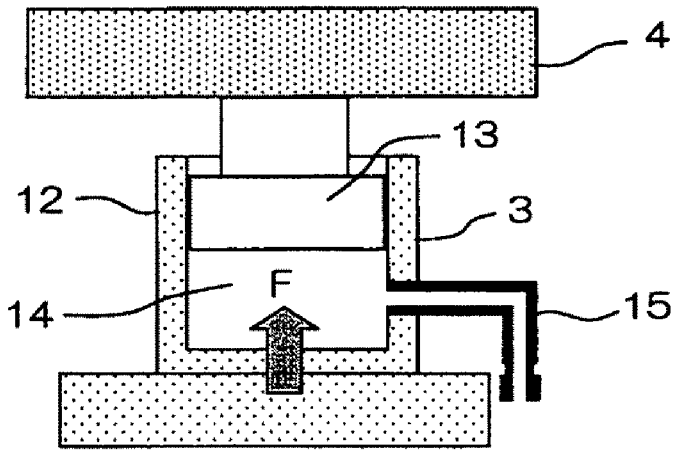
FIG. 7 is a schematic enlarged cross sectional view of portion A in FIG. 4 illustrating a coupling structure between the holding mechanism and the base.

Referring to FIG. 4, holding mechanism 3 supports lapping head 2, and also cooperates with base 4 in order to correct the vertical position of lapping head 2 in a self controlled manner in accordance with the uneven surface condition of lapping plate 5. FIG. 7 is a schematic enlarged cross sectional view of portion A in FIG. 4, showing a coupling structure between the holding mechanism and the base. Holding mechanism 3 has cylinder 12 (first engaging member) at the upper end thereof. Cylinder 12 extends in the vertical direction and is open at the upper end thereof. Base 4 has piston 13 (second engaging member) that faces cylinder 12 and that extends in the vertical direction. Piston 13 is fitted into cylinder 12. However, piston 13 does not reach the lower end of cylinder 12 so that internal space 14 is formed by piston 13 and cylinder 12. Internal space 14 is connected to one end of air tube 15, and the other end of air tube 15 is connected to a vacuum pump (not shown). Air tube 15 and the vacuum pump form a decompressing mechanism to decompress internal space 14 (to form negative pressure in internal space 14) relative to the atmospheric pressure.

When internal space 14 is decompressed, holding mechanism 3 is subjected to upward force F in the vertical direction from the decompressed internal space 14. The magnitude of force F depends on the degree of decompression (the degree of vacuum), but is preferably set to a magnitude with which the weight of holding mechanism 3 and lapping head 2 connected to holding mechanism 3 can be substantially canceled. Because of the static friction between piston 13 and cylinder 12 and the static friction between groove 20 of base 4 and projection 21 of holding mechanism 3, which will be explained later, cylinder 12 is maintained in a stationary state relative to piston 13. In this state, holding mechanism 3 and lapping head 2 are, so to speak, put in a floating state, in which holding mechanism 3 and lapping head 2 highly sensitively responds to any vertical external force so that they can move and stop in the vertical direction in response to the external force. Holding mechanism 3 and lapping head 2 are supported by base 4 in this manner.

Figure 8:
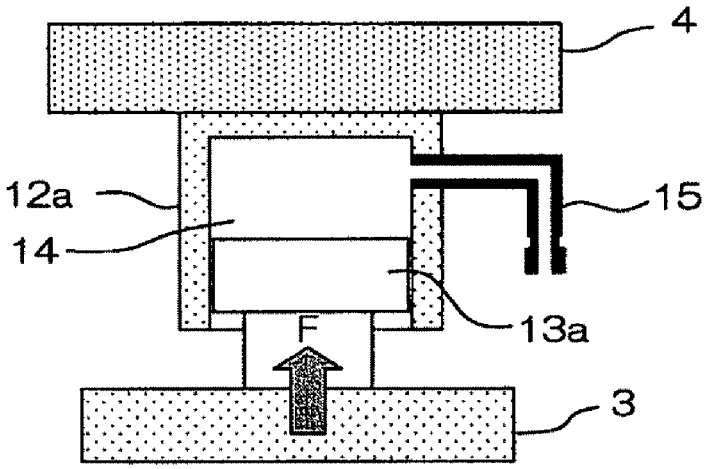
FIG. 8 is a schematic enlarged cross sectional view of portion A in FIG. 4 illustrating another coupling structure between the holding mechanism and the base.

In the above embodiment, holding mechanism 3 has cylinder 12, and base 4 has piston 13. However, holding mechanism 3 may have piston 13*a*, and base 4 may have cylinder 12*a*, as shown in FIG. 8. Further, since no force F is generated when internal space 14 is not decompressed, a stopper (not shown) is desirably provided to help base 4 support holding mechanism 3 in a non-decompressed state. The stopper may be provided at the engaging portion between cylinder 12 and piston 13, or may be provided between groove 20 of base 4 and projection 21 of holding mechanism 3.

Referring again to FIG. 4, base 4 has fixed frame member 16 to support lapping plate 5 and guide member 18 which is movable in the vertical direction relative to frame member 16. Piston (second engaging member) 13 described above is mounted to guide member 18. Frame member 16 and guide member 18 are coupled to each other by means of ball screw 19*a*, which is mounted to frame member 16, and nut 19*b*, which is mounted to guide member 18 in order to be engaged with ball screw 19*a*. The configuration in which guide member 18 is movable in the vertical direction relative to frame member 16 is advantageous, for example, when a space is required between lapping head 2 and plate 5 in order to mount bar B to lapping head 2. The coupling structure between frame member 16 and guide member 18 is not limited to the combination of ball screw 19*a* and nut 19*b*, as long as guide member 18 can be supported movably in the vertical direction relative to frame member 16. Any structures, such as combination of a rack and a pinion, a linear motor and so on, may be used.

Guide section 18 has vertically extending groove 20 (first engaging section). Holding mechanism 3 has projection 21 (second engaging section) that extends vertically and that is engaged with groove 20. If holding mechanism 3 moves in a direction that is other than the vertical direction during lapping, then lapping head 2 that is mounted to holding mechanism 3 may be inclined, and, for example, bar B that is mounted to lapping head 2 may disadvantageously come into contact with lapping plate 5 at one side thereof. Holding mechanism 3, which is only movable in the vertical direction relative to guide member 18 due to the cooperation between groove 20 and projection 21, prevents such a problem. The same effect can also be obtained by the structure in which guide member 18 has projection 21 and holding mechanism 3 has groove 20. It should be noted that the space between groove 20 and projection 21 should be appropriately adjusted in order to prevent any movement in a direction other than the vertical direction. If static friction between groove 20 and projection 21 is too large, then smooth movement of holding mechanism 3 relative to guide member 18 may be prevented. Therefore, a surface treatment may be performed to reduce the friction.

Lapping apparatus 1 further includes distance detecting apparatus 23 to detect the distance between pusher supporting section 8 and lapping plate 5. Distance detecting apparatus 23 may be, for example, a sensor using infrared rays. Distance detecting apparatus 23 is operated when holding mechanism 3 and lapping head 2, to which bar B is mounted, move toward lapping plate 5 according to the rotation of ball screw 19*a*.

Lapping plate 5 is formed of tin (Sn) and includes diamond abrasive grains embedded therein. Lapping plate 5 has a rotation shaft (not shown) so that lapping plate 5 is rotated by means of a motor (not shown). Lapping plate 5 has a slightly concave shape in the upward direction in order to provide elements S with an appropriate crown shape. For example, lapping plate 5 has a curvature in the order of 5 m to 30 m.

Figure 9:
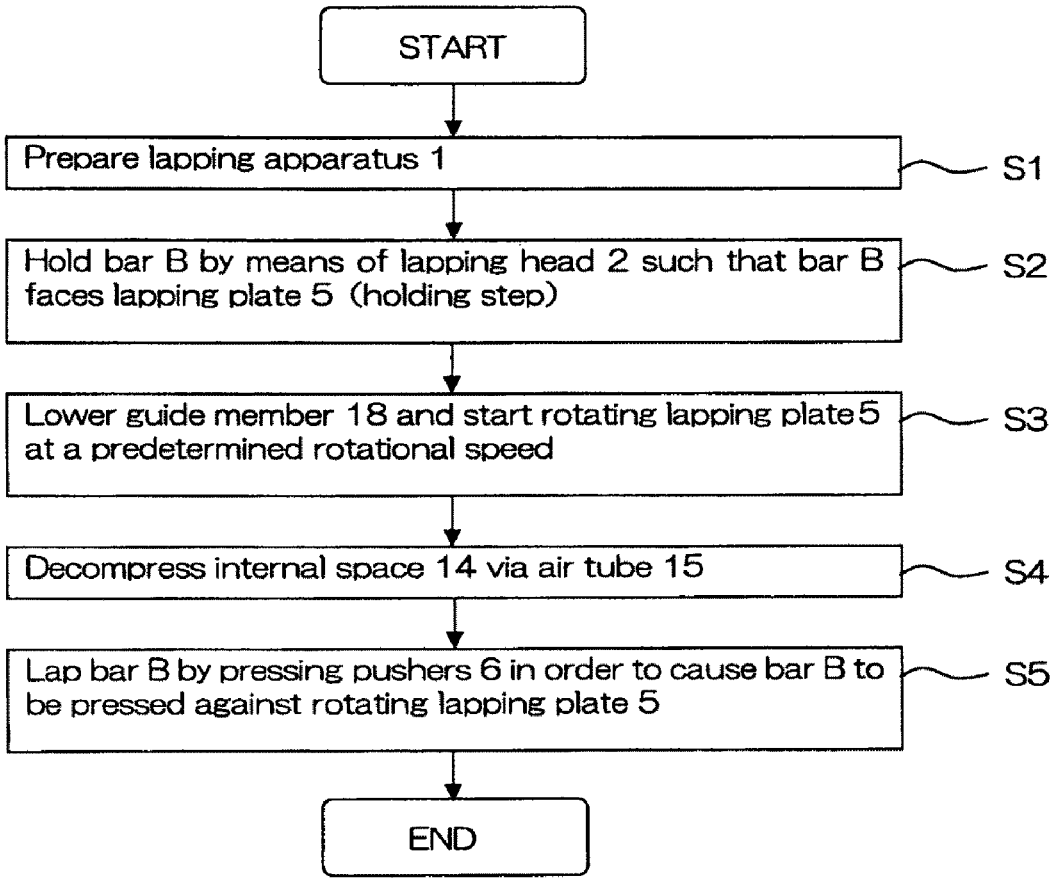
FIG. 9 is a flow chart showing a method for lapping sliders according to an embodiment of the present invention.

Next, a method for lapping sliders using lapping apparatus 1 explained above will be explained with reference to the flow chart in FIG. 9. In a typical method for manufacturing a slider, a number of elements are formed on a wafer in the wafer process, and after the back surface of the wafer is lapped (backside lapping), the wafer is diced into blocks or bars, which are then subjected to the rough lapping process described above. Subsequently, the element height forming lapping process and the surface finishing lapping process are performed. A DLC (Diamond like Carbon) film is then coated on the air bearing surface to protect the same. The bar is separated into sliders and each slider is attached to a HGA (Head Gimbal Assembly). Since the present embodiment is characterized by the surface finishing lapping process, explanations on other processes are omitted. However, it should be noted that the lapping method of the present embodiment can also be applied to lapping processes other than the surface finishing lapping process.

Figure 10:
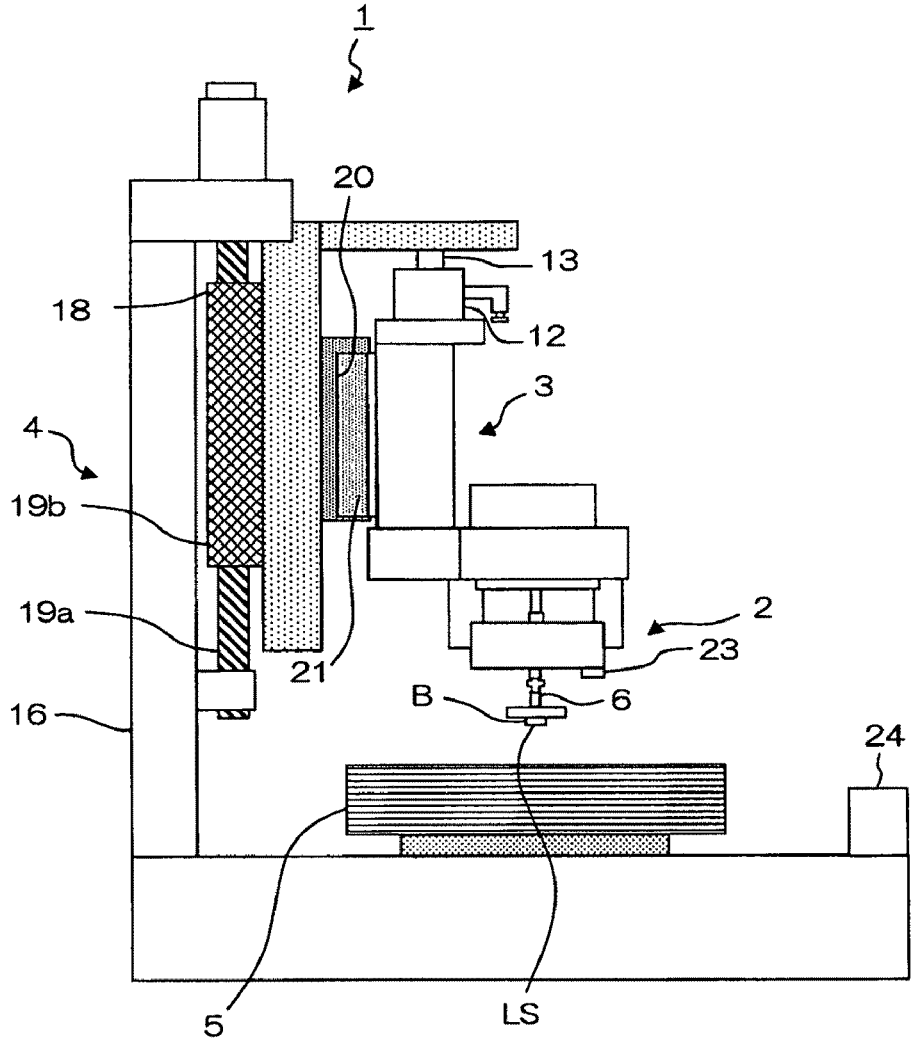
FIG. 10 is a conceptual view of a lapping apparatus showing a state in which a bar is mounted to the lapping apparatus before the surface finishing lapping process is performed.

(Step 1) First, lapping apparatus 1 described above is prepared. FIG. 10 is a conceptual view of lapping apparatus 1 in a state in which bar B is mounted to lapping apparatus 1 before the surface finishing lapping process is performed. Cylinder 12 (first engaging member) and piston 13 (second engaging member) are engaged with each other in advance to form internal space 14. Guide section 18 is lifted upward by means of ball screw 19*a* so that a space is formed between lapping head 2 and lapping plate 5.

(Step 2) Next, bar B is held by lapping head 2 such that bar B faces lapping plate 5 (holding step). Bar B is mounted on lapping head 2 using the space that is formed between lapping head 2 and lapping plate 5 in the previous step, as mentioned above. Specifically, bar B is first mounted on lapping head 2 via rubber sheet G. Lapping head 2 is provided with a vacuum suction device (not shown) so that bar B is securely held by lapping head 2. Furthermore, probes or the like are attached to the pads that are provided in bar B, and preparation for detecting a change in electric resistance of RLG elements R during lapping is completed. The relationship between the lapping amount of RLG element R and the electric resistance thereof is estimated in advance.

(Step 3) Next, ball screw 19*a* is rotated in order to lower guide member 18. Guide member 18 is stopped when distance detecting apparatus 23 detects a predetermined distance between pusher supporting section 8 and lapping plate 5. At this point, bar B is not in contact with lapping plate 5, but is located slightly above lapping plate 5. Next, lapping plate 5 is actuated and starts rotation at a predetermined rotational speed.

(Step 4) Next, internal space 14 is decompressed via air tube 15. As a result, holding mechanism 3 is subjected to upward force F (see FIG. 7) in the vertical direction from decompressed internal space 14. By releasing the stopper described above, holding mechanism 3 is put in a floating state so that it is movably supported relative to base 4 in the vertical direction.

(Step 5) Next, air is supplied into internal space 32 of pushing force adjusting member 31 via air tube 10 and cylinder 52. As described above, pushing force adjusting member 31 elastically deforms in the direction of bar B, thereby pushes pusher 6, and presses bar B against rotating lapping plate 5 in order to start lapping bar B. RLG elements R, which are provided adjacent to elements S on lapping surface LS, are lapped simultaneously with elements S, and the electric resistance of RLG elements R is continuously monitored during lapping. The height (unevenness) of lapping plate 5 at the position where lapping plate 5 is in contact with elements S varies depending on the locations on lapping plate 5 in the radial direction because of the local unevenness of lapping plate 5 or because of the inaccuracy with which lapping plate 5 is mounted in the horizontal direction. As a result, the average pressing forces applied to respective elements S are different from each other. Since the average pressing force applied to each element S is generally proportional to the lapping amount of element S, the average pressing force applied to each element S can be estimated by detecting a change in electric resistance of RLG elements R. The air pressure in internal space 32 is controlled in accordance with the average pressing force that is detected, so that the strokes of pushers 6 in the direction of lapping plate axis C can be individually controlled. In this way, it is possible to lap bar B while controlling the pressing force at the location of each element S with which pusher 6 presses bar B against lapping plate 5. It should be noted that the pushing force of pusher 6 can be accurately controlled in accordance with the air pressure in internal space 32 because the position of pusher 6 can be controlled by the elastic deformation of pushing force adjusting member 31. The lapping step is completed when the electric resistance of RLG elements R reaches a target value of the electric resistance which is predetermined based on the relationship between the lapping amount of RLG element R and the electric resistance of the same.

Figure 11:
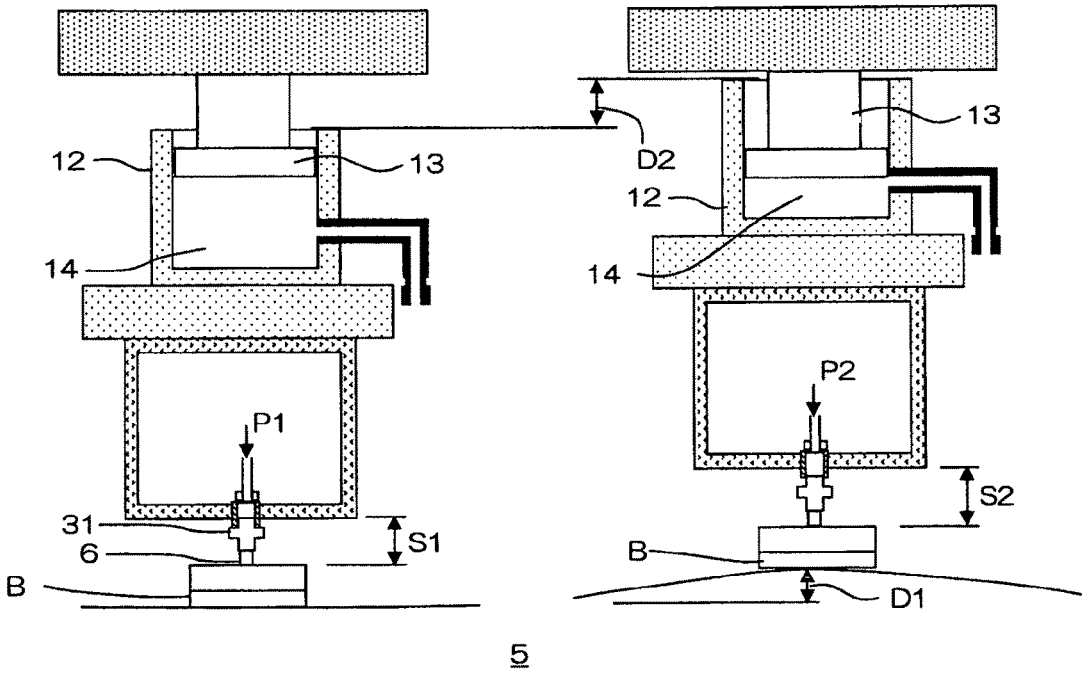
FIG. 11 is a conceptual view showing the effect of the present invention.

As described above, holding mechanism 3 is vertically supported by base 4 in a floating state. The effect obtained by this configuration will be explained with reference to FIG. 11. The left part of the figure shows a state in which the surface of lapping plate 5 is located at a relatively low elevation. The right part of the figure shows a state in which the surface of lapping plate 5 is located at a relatively high elevation. For illustrative purpose, the difference between the left and right parts of the figure is emphasized, but actually the difference is significantly small. When bar B is in the state of the left part of the figure, the distance between pusher supporting member 8 and the lower end of pusher 6 is S1, and the pressure in internal space 32 of pushing force adjusting member 31 is P1. The upper end of cylinder 12 is positioned near the lower end of piston 13. Since internal space 14 is under a negative pressure that cancels the weight of holding mechanism 3 and lapping head 2, holding mechanism 3 and lapping head 2 are substantially held in a floating state.

Next, assume the state of the right part of the figure in which lapping plate 5 is further rotated and the surface level of lapping plate 5 is raised by height D1 at the position where lapping plate 5 is in contact with bar B. Since bar B is raised by height D1, holding mechanism 3 and lapping head 2 are also raised by the same height D1. For convenience of description, assume that height D1 is constant in the longitudinal direction of bar B. Since piston 13 is fixed to base 4 and is kept immobile, cylinder 12 is raised relative to piston 13 and internal space 14 is reduced in accordance with the vertical movement of cylinder 12. The height by which holding mechanism 3 and lapping head 2 are raised is not the same as height D1 because of various factors, such as inertia of holding mechanism 3 and lapping head 2 themselves, friction between cylinder 12 and piston 13, and friction between guide member 18 and projection 21. Usually, holding mechanism 3 and lapping head 2 are raised by height D2 that is larger than height D1 because of the inertia of holding mechanism 3 and lapping head 2 themselves. However, once holding mechanism 3 and lapping head 2 are raised and the influence of the inertia disappears, the friction between cylinder 12 and piston 13 and the friction between guide member 18 and projection 21 become dominant, and holding mechanism 3 and lapping head 2 are stopped at the raised position. Since height D1 is actually in the order of nanometers, the increase in the pressure in internal space 14 is negligible. Therefore, holding mechanism 3 and lapping head 2 return to an equilibrium state again at the raised position and recover the floating state. In this way, reaction force (thrust) that is applied from lapping plate 5 against bar B when bar B passes over a convex portion of lapping plate 5 is absorbed, and thereby a rapid increase in the pressing force against bar B is limited. The variation in the pressing force is a major factor which causes variation in the lapping amount of elements S, and as a result, the variation in the lapping amount of elements S during lapping is reduced.

If the surface height of lapping plate 5 becomes less than height D1 at the position where lapping plate 5 contacts with bar B as a result of further rotation of lapping plate 5, then bar B is no longer pushed upward by lapping plate 5, and accordingly, holding mechanism 3 and lapping head 2 are no longer raised. However, if the surface height of lapping plate 5 at the position where lapping plate 5 comes into contact with bar B becomes more than height D1, the above described movement is repeated. Usually, the upward movement of holding mechanism 3 and lapping head 2 is substantially completed when lapping plate 5 makes one revolution, and subsequent pushing motion against bar B is substantially prevented. According to the present embodiment, the elevation of bar B relative to lapping plate 5 is changed to an elevation at which pushing motion from lapping plate 5 can be narrowly prevented. Moreover, this movement occurs in a self controlled manner through the rotation of lapping plate 5. It should be noted that the surface condition of lapping plate 5 and bar B continuously change during lapping, and accordingly, the positional relationship between lapping plate 5 and bar B also changes continuously depending on the surface condition. Therefore, it is possible that holding mechanism 3 and lapping head 2 are raised again during lapping. However, this movement also occurs in a self controlled manner through the rotation of lapping plate 5, and bar B can always be maintained at an optimum elevation relative to lapping plate 5 all through the lapping process.

Meanwhile, holding mechanism 3 and lapping head 2 are usually raised, as described above, and the pressing force applied from pushers 6 is decreased as the upward movement progresses. However, the reduction in the pressing force is limited because the upward movement of holding mechanism 3 and lapping head 2 is in the order of several nanometers. The reduction in the pressing force is also mitigated because of the resiliency of rubber sheet 21 through which bar B is pressed against lapping plate 5 by pushers 6. As a result, variation in the pressing force can be minimized.

In the present embodiment, the variation in the pressing force can be further limited because the protruding lengths of pushers 6 are individually controlled. A change in the pressing force causes a change in the lapping amount. The lapping amount of each element S can be estimated by monitoring the change in the electric resistance of RLG element R, as described above. In the present embodiment, the lapping amount of each element S can be individually controlled by adjusting the deformation of pushing force adjusting member 31 located right above each element S and thereby by adjusting the protruding length of pushers 6. In the right part of FIG. 11, since lapping head 2 is raised by height D2 that is larger than height D1, the pressure in internal space 32 of pushing force adjusting member 31 is increased to P2, and the distance between pusher supporting member 8 and the lower end of pusher 6 is increased to S2. Accordingly, the pressing force can be maintained at a certain magnitude before and after bar B passes over a convex portion. Moreover, since the pressing force can be adjusted for each element S, variation in the pressing force can be further reduced. It should be noted that the optimum positional relationship between bar B and lapping plate 5 may be broken by adjusting the distance between pusher supporting member 8 and the lower end of pusher 6. However, the positional relationship between bar B and lapping plate 5 is automatically corrected to a new optimum positional relationship due to the upward movement of holding mechanism 3 and lapping head 2, as described above.

Figure 12A:
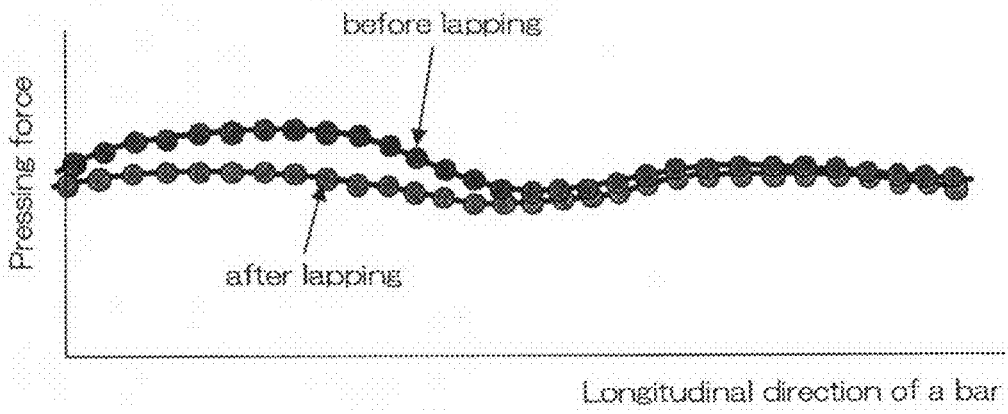
FIG. 12A is a conceptual diagram showing the pressing force of a pusher before and after lapping according to prior art.
Figure 12B:
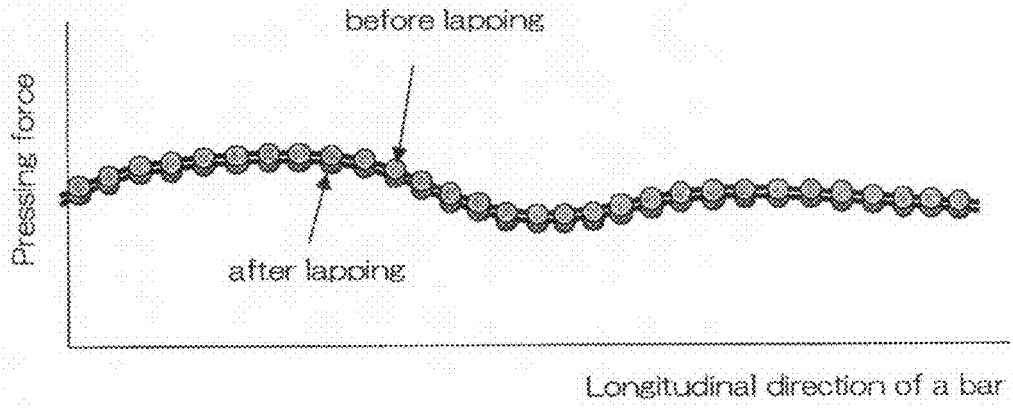
FIG. 12B is a conceptual diagram showing the pressing force of a pusher before and after lapping according to present embodiment.

FIGS. 12A and 12B are conceptual diagrams comparing the pressing force of a pusher according to the present embodiment and according to prior art. FIG. 12A shows the pressing force of a pusher before and after lapping according to prior art. The horizontal axis corresponds to the longitudinal direction of a bar. In prior art, the position of a bar relative to a lapping plate is set before lapping, and is not changed during lapping. The pressing force after lapping is considerably reduced at some positions as compared to the pressing force before lapping. This means that the bar slightly floats from the lapping plate. This is because the bar is excessively lapped under strong pressing force during lapping. As a result, the bar is partially lapped in a large amount and partially lapped in a small amount. This implies that the element height that is uniformly formed in the element height forming lapping process varies in the surface finishing lapping process. In the surface finishing lapping process, it is important to keep variation in the element height as small as possible and thereby to uniformly lap a bar.

FIG. 12B shows the pressing force of a pusher before and after lapping according to the present embodiment. In the present embodiment, since unevenness of a lapping plate is effectively absorbed, strong pressing force can be prevented during lapping. Therefore, the pressing force can be kept generally constant, although it is slightly reduced.

Although certain preferred embodiments of the present invention have been shown and described in detail, it should be understood that various changes and modifications may be made without departing from the spirit or scope of the appended claims.

What is claimed is:

1. An apparatus for lapping sliders comprising:

a rotatable lapping plate for lapping elements that are to be formed into sliders, a pushing force adjusting member that has an internal space therein and that extends vertically along an lapping plate axis that is perpendicular to the lapping plate, a pusher for pressing the elements, the pusher being connected to the pushing force adjusting member, and gas supply means for supplying a gas into the internal space, the gas supply means being connected to the pushing force adjusting member, wherein the pushing force adjusting member comprises a first part that includes a connection with the pusher, a second part that includes a coupling between the internal space and the gas supply means, and an axially deformable part that is located between the first part and the second part, wherein a length of the axially deformable part changes in a direction of the lapping plate axis in accordance with pressure in the internal space such that deformation of the axially deformable part causes a change in the pushing force of the pushing force adjusting member against the pusher, the first part has a cylindrical shape which has a closed end that is located on a side of the connection with the pusher, and which has an open end that is located on a side opposite to the connection;

the second part has a cylindrical shape which has an open end that is located on a side of the coupling with the gas supply means, and which has another open end that is located on a side opposite to the coupling; and the axially deformable part includes:

a first circular part which has the lapping plate axis as a center axis thereof, wherein an inner circumference of the first circular part corresponds to an outer circumference of the end of the first part, the end being located on the side that is opposite to the connection;

a second circular part which has the lapping plate axis as a center axis thereof, wherein an inner circumference of the second circular part corresponds to an outer circumference of the end of the second part, the end being located on the side that is opposite to the coupling; and a cylindrical part that connects the first circular part with the second circular part along outer circumferences thereof.

2. The apparatus according to claim 1, wherein the pushing force adjusting member is formed of a rubber.

3. An apparatus for lapping sliders comprising:

a rotatable lapping plate for lapping elements that are to be formed into sliders, a pushing force adjusting member that has an internal space therein and that extends vertically along an lapping plate axis that is perpendicular to the lapping plate, a pusher for pressing the elements, the pusher being connected to the pushing force adjusting member, and gas supply means for supplying a gas into the internal space, the gas supply means being connected to the pushing force adjusting member, wherein the pushing force adjusting member comprises a first part that includes a connection with the pusher, a second part that includes a coupling between the internal space and the gas supply means, and an axially deformable part that is located between the first part and the second part, wherein a length of the axially deformable part changes in a direction of the lapping plate axis in accordance with pressure in the internal space such that deformation of the axially deformable part causes a change in the pushing force of the pushing force adjusting member against the pusher, the apparatus for lapping sliders further comprising:

a lapping head that includes the pushing force adjusting member, the pusher and the gas supply means, a holding mechanism which has a vertically extending first fitting member and which supports the lapping head, a base for supporting said holding mechanism, said base having a vertically extending second engaging member, wherein said second engaging member is engaged with said first engaging member so as to form an internal space therebetween; and a decompressing mechanism for decompressing said internal space, wherein said holding mechanism is subjected to vertically upward force from the decompressed internal space in order to be movably supported by said base in the vertical direction.

4. The apparatus according to claim 3, wherein said first engaging member is a cylinder provided in said holding mechanism, and said second engaging member is a piston provided in said base.

5. The apparatus according to claim 3, wherein said first engaging member is a piston provided in said holding mechanism, and said second engaging member is a cylinder provided in said base.

* * * * *